United States Patent [19]

Scourtes

[11] 4,343,348

[45] Aug. 10, 1982

[54] APPARATUS AND METHODS FOR SIMULATING VARYING ATMOSPHERIC CONDITIONS

[75] Inventor: George Scourtes, Livonia, Mich.

[73] Assignee: The Allen Group, Saginaw, Mich.

[21] Appl. No.: 156,982

[22] Filed: Jun. 6, 1980

Related U.S. Application Data

[63] Continuation of Ser. No. 912,009, Jun. 2, 1978, abandoned.

[51] Int. Cl.[3] ..... F25B 29/00

[52] U.S. Cl. ..... 165/1; 165/30; 165/48 R; 73/118; 62/90; 62/402

[58] Field of Search ..... 62/90, 402; 73/118; 165/48, 1, 30

[56] References Cited

U.S. PATENT DOCUMENTS

| | | | |
|---|---|---|---|
| 3,528,080 | 9/1970 | Greene et al. | 73/118 |
| 3,785,755 | 1/1974 | Novak et al. | 62/90 X |
| 3,851,523 | 12/1974 | Converse et al. | 73/118 |
| 4,017,285 | 4/1977 | Edwards | 62/402 X |
| 4,030,351 | 6/1977 | Smith | 73/118 |

*Primary Examiner*—Albert W. Davis
*Assistant Examiner*—Margaret A. Focarino
*Attorney, Agent, or Firm*—Learman & McCulloch

[57] ABSTRACT

Apparatus and methods for simulating varying atmospheric conditions comprises an enclosure that is sealed except for an air inlet and an air outlet by means of which air is admitted to and exhausted from the enclosure. The inlet of the enclosure is connected to a compressed air source and the outlet of the enclosure is connected to a vacuum pump. Adjustment of the flow rates of air into and from the enclosure results in changes in the air pressure within the enclosure to simulate barometric pressure changes from below to well above sea level. Air admitted to the enclosure is temperature and moisture conditioned to simulate changes in atmospheric temperature and humidity conditions. Apparatus and methods according to the disclosure are particularly suited for the testing and calibration of vehicle carburetors.

11 Claims, 1 Drawing Figure

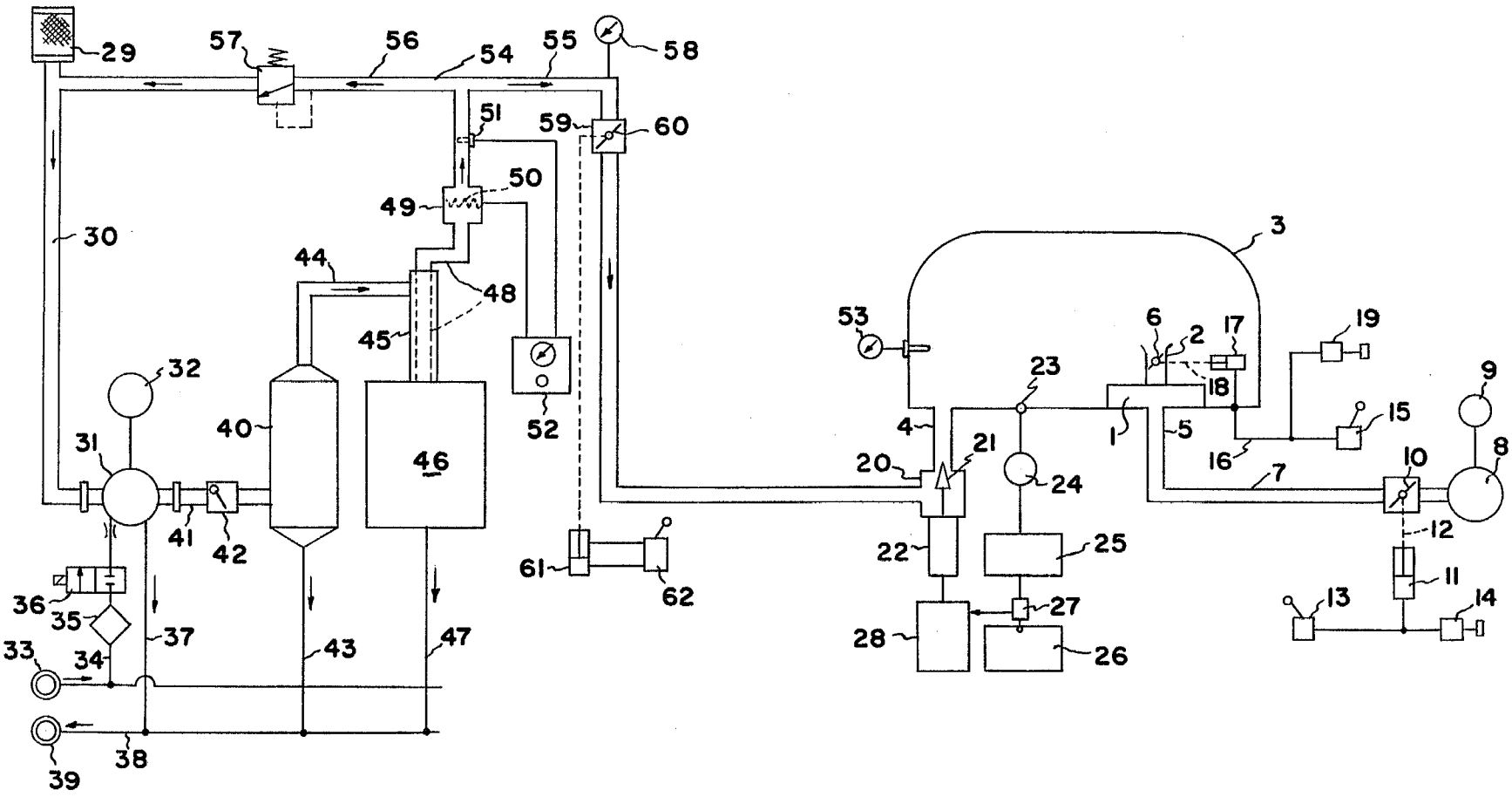
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62

APPARATUS AND METHODS FOR SIMULATING VARYING ATMOSPHERIC CONDITIONS

This is a continuation of application Ser. No. 912,009, filed in U.S. Pat. and Trademark Office on 6-2-78, now abandoned.

BACKGROUND OF THE INVENTION

In the manufacture of vehicle carburetors it is essential that they be adjusted and calibrated so as to function efficiently under widely differing atmospheric conditions. For example, a vehicle's carburetor must be capable of functioning properly at high altitude, such as in mountainous areas, and it also must be capable of functioning substantially equally well at sea level and lower altitudes. Each carburetor, therefore, must be subjected to calibration procedures under conditions simulating quite accurately the various atmospheric conditions, i.e., barometric, humidty, and temperature, that are likely to be encountered in use.

Various carburetor calibration systems have been proposed heretofore, examples of which are disclosed in U.S. Pat. Nos. 3,928,080; 3,851,523; 3,975,953; 3,517,552; and 3,524,344.

If a carburetor is to be tested under conditions simulating barometric pressures higher than the ambient pressure, the air utilized in the testing must be compressed. Compression of air, however, customarily is accompanied by a substantial increase in its temperature. It is extremely rare that the temperature of compressed air corresponds to the temperature at which a carburetor is to be tested, so it is conventional to pass the compressed air through refrigeration apparatus for the purpose of cooling the air. The cooling process for the compressed air, however, conventionally requires substantially large refrigeration apparatus because of the generation of heat due to compression, thereby resulting in excessive energy consumption. The air subsequently is heated and moisturized as required to simulate desired atmospheric conditions.

A principal object of the invention is to provide a system for simulating different atmospheric conditions and which minimizes considerably the complexity and energy requirements of previously known systems for similar purposes.

SUMMARY OF THE INVENTION

A system constructed and operated in accordance with the invention includes an enclosure in which a carburetor may be mounted for test and calibration purposes and into which preconditioned air is delivered for exhaust through the carburetor under different atmospheric conditions. Air admitted to the enclosure is compressed in the presence of circulating moisture which absorbs a considerable quantity of heat generated by compression and moisturizes the compressed air. The compressed, moisturized air is delivered from the compressor to a separator in which excessive moisture is removed. The air then is delivered to a refrigerating apparatus at which it is further dried and cooled to a predetermined lower temperature. From the refrigerating apparatus the air passes through a heating device in which its temperature is raised to a predetermined level, following which the air is delivered to the enclosure at a predetermined rate. Air is exhausted from the enclosure via the carburetor at a predetermined rate which is so related to the rate of air delivery to the enclosure as to enable the pressure within the enclosure to be varied within wide limits.

DESCRIPTION OF THE DRAWING

Apparatus and methods according to the invention are explained in the following description with reference to the accompanying drawing which is a simplified, schematic illustration of a carburetor calibration facility incorporating apparatus constructed and arranged in accordance with the invention.

DESCRIPTION OF THE PREFERRED EMBODIMENT

Apparatus constructed in accordance with the illustrated embodiment of the invention is incorporated in a carburetor test facility within which is a stand 1 on which a carburetor 2 to be tested is removably mounted. The stand 1 is mounted within a hood or enclosure 3 which is sealed except for an air inlet 4 and an air outlet 5. The outlet 5 communicates with the enclosure 3 in such manner that air from within the enclosure is exhausted through the carburetor 2 under the control of the latter's butterfly valve 6. The outlet 5 is in communication with a conduit 7 that leads to a vacuum pump 8 which is driven by a motor 9, thereby enabling air to be exhausted from the enclosure at a predetermined rate. An adjustable valve 10 in the outlet conduit 7 enables the rate of flow of air out of the enclosure to be varied. The valve 10 is adjusted by means of an operating cylinder 11 connected by linkage 12 to the valve. The cylinder is operated by a control valve 13 and a vernier control 14.

Adjustments of the butterfly valve 6 are effected from outside the enclosure 3 by a throttle control valve 15 connected by a hydraulic line 16 to an operating cylinder 17 within the enclosure and connected by a linkage 18 to the butterfly valve. Fine adjustments of the butterfly valve are obtained by means of a hydraulic, vernier control 19.

Associated with the inlet 4 is a valve housing 20 within which is an adjustable valve 21 that is movable by a motor 22 in a manner to increase and decrease the flow of air into the enclosure 3. A pressure sensor 23 extends into the enclosure 3 and is coupled to a pressure transducer 24. The transducer is coupled to a digital pressure indicator 25 which functions to indicate, in inches of mercury, the pressure within the enclosure 3. A manually settable pressure indicator 26, like the indicator 25, may be preset to the pressure desired to be maintained within the enclosure 3, and between the indicators 25 and 26 is a differential pressure transducer or bridge 27 that is responsive to differences between the pressures indicated by the indicators 25 and 26 to generate an electrical signal that is fed to an amplifier 28 and thence to the motor 22 to effect adjustment of the valve 21 in such directions as to increase or decrease the flow of air into the enclosure to maintain the pressure therein at a level corresponding to that preset on the indicator 26.

Air to be delivered to the enclosure 3 is introduced to the system through a filter inlet source 29 and conducted by a conduit 30 to an air compressor 31 that is driven by an electric motor 32. The compressor 31 is a water sealed compressor such as that manufactured by The Nash Engineering Company, Norwalk, Connecticut, and which is supplied with water from a main 33 via a conduit 34 in which are a filter 35 and a control valve 36. Water is discharged from the compressor 31 through a line 37 that is connected to a drain pipe 38 that is connected to a conduit 39. The construction and operation of the compressor 31 are such that air is compressed in the presence of moisture which absorbs a substantial amount of the heat generated by compression. A substantial portion of the heat is discharged from the compressor with the drain water, but the compressed air conventionally is saturated with moisture.

Moist air is discharged from the compressor 31 to a centrifugal separator 40 via a line 41 provided with a swing check valve 42. Water separated from air in the separator 40 is discharged from the latter via a conduit 43 to the drain line 38, whereas the air is discharged from the separator to a connecting line 44 that is joined to the inlet pipe 45 of a well-known, combined refrigerator and air dryer 46 such as is manufactured by Wilkerson Corporation, Englewood, Colorado.

Air admitted to the unit 46 is cooled to a predetermined temperature such as to condense moisture in the air, water thus extracted from the air being discharged through a line 47 to the drain pipe 38. Cooled air at a predetermined humidity level is discharged via a conduit 48 having a portion thereof within and concentric with the inlet pipe 44 so as to provide for a heat exchange between the inlet 44 and the outlet 48. Air discharged from the refrigerator-dryer unit 46 may be at a temperature lower than that desired to be admitted to the enclosure 3, so the air is conducted through a heating chamber 49 in which is located an electrical heating element 50. A temperature probe 51 in the outlet conduit 48 downstream of the heating chamber 49 is coupled to an adjustable thermostat 52 that controls the operation of the heating element 50 for the purpose of maintaining the compressed air at a substantially uniform, preselected termperature which will enable a predetermined temperature to be maintained in the enclosure 3 as indicated by a thermometer 53.

The conduit 48 is joined to a line 54 having a first branch 55 connected to the housing 20 for the valve 21 so as to deliver compressed air to the enclosure inlet 4. The line 54 has a by-pass or second branch 56 connected to the air inlet pipe 30 via a pressure relief valve 57. The branch 55 includes a pressure gauge 58 by means of which the absolute pressure of air in the branch 55 may be determined. The valve 57 may be adjusted to prevent the pressure of air in the branch 55 from exceeding a predetermined value.

The branch 55 includes a housing 59 in which is mounted a butterfly valve 60 the position of which may be varied by means of a hydraulic cylinder 61 having an adjustable control mechanism 62 so as to establish a variable, predetermined volumetric air flow to the enclosure inlet 4.

To condition the system for operation, a carburetor 2 to be tested is placed on the stand 1 and the vacuum pump 8 and the compressor 31 operated so as to cause a flow of air from within the enclosure 3 through the carburetor 2. The carburetor's butterfly valve 6 is adjusted to one of a number of predetermined positions so as to establish a selected, predetermined volumetric air flow through the carburetor.

The compressor 31 draws air through the filter inlet 29 and compresses the air in the presence of moisture, excess water being discharged to the drain 38. Moisturized, compressed air is delivered to the separator 40 for further water separation and then is delivered to the refrigerator-dryer unit 46 for drying and cooling. Cooled, relatively dry air is discharged from the unit 46 at a temperature normally lower than that at which it is to be introduced to the enclosure 3. The concentric arrangement of the conduits 45 and 48 enables air enroute to the unit 46 to be precooled prior to entry into the unit 46 and conversely, enables cooled air from the unit 46 to be preheated enroute to the heating chamber 49. Air passing through the chamber 49 is heated to a temperature corresponding to that at which it is to be delivered to the enclosure 3. The warmed air then is delivered via the control valve 21 to the enclosure inlet 4 for discharge through the carburetor 2.

The rate at which air is delivered to and withdrawn from the enclosure 3 determines the pressure within the latter. That is, if compressed air is supplied to the enclosure 3 at a rate greater than that at which it is withdrawn, the pressure within the enclosure will be greater than atmospheric, thereby simulating a relatively high barometric pressure. On the other hand, if the rate at which air is withdrawn from the enclosure is greater than that at which air is admitted to the enclosure, then the pressure within the enclosure will be less than atmospheric, thereby simulating a lower barometric pressure such as that encountered at high altitudes.

The pressure within the enclosure 3 is maintained at a preselected, desired level by means of the sensor 23, the transducer 24, the indicators 25 and 26, the bridge 27, the amplifier 28, and the valve driving motor 22, it being understood that the valve 21 is adjusted to allow more or less air to pass into the enclosure as may be required to maintain a substantially constant, predetermined pressure.

The disclosure is representative of presently preferred apparatus and methods according to the invention, but is intended to be illustrative rather than definitive thereof. The invention is defined in the claims.

I claim:

1. In a system for simulating varying atmospheric conditions within a hood that is sealed except for an air inlet and an air outlet, said system including exhaust means communicating with said outlet for exhausting air from said hood, and adjustable valve means in said inlet for varying the amount of air that may be admitted to said hood, the improvement comprising compressor means in communication with a source of air operable to compress air in the presence of liquid to minimize a rise in the temperature of said air due to its compression; discharge means for discharging a quantity of liquid directly from said compressor; separator means in communication with said compressor independently of said discharge means for separating additional liquid from compressed air; refrigerator means in communication with said separator means for cooling said compressed air; means connecting said refrigerator means to said inlet upstream from said valve means; and heating means in said connecting means for heating refrigerated compressed air enroute to said inlet, said heating means comprising a first conduit extending from said separator means and a second conduit extending from said refrigerator means, said first and second conduits having portions thereof concentric with one another.

2. A system according to claim 1 wherein said first conduit has its concentric portion external of the corresponding portion of said second conduit.

3. A system according to claim 1 wherein said refrigerator means cools said compressed air to a temperature at which moisture therein condenses.

4. A system according to claim 3 including heating means between said refrigerator means and said valve means for heating compressed air enroute to said inlet.

5. A system according to claim 4 wherein said heating means comprises an electrical heating element within said connecting means in the path of flow of said compressed air.

6. A system according to claim 5 including thermostatic control means in said connecting means downstream from said heating element and coupled to said heating element for controlling the operation thereof.

7. In a method of simulating different atmospheric conditions within an enclosure that is sealed except for an air inlet and an air outlet, said method including exhausting air from said enclosure via said outlet and admitting air into said enclosure selectively at rates such as to establish within said enclosure a pressure that is selectively greater, lesser, or the same as ambient barometric pressure, the improvement comprising compressing air to be introduced to said enclosure in an excessively moisture rich environment to enable such moisture to absorb heat from the compressed air; separating compressed air and excess moisture during the compression of said air and discharging the excess moisture and compressed air along separate paths; extracting additional moisture from said air following its compression; and separating said additional moisture from said compressed air prior to the introduction of said compressed air to said enclosure.

8. A method according to claim 7 including cooling said compressed air.

9. A method according to claim 8 including heating said compressed air following its cooling.

10. A method according to claim 8 including heating said compressed air to a predetermined temperature following its cooling.

11. In a system for simulating varying atmospheric conditions within a hood that is sealed except for an air inlet and an air outlet, said system including exhaust means communicating with said outlet for exhausting air from said hood, and adjustable valve means in said inlet for varying the amount of air that may be admitted to said hood, the improvement comprising air compressor means; means for supplying air to said compressor means; means for supplying to said compressor means liquid in an amount such as to enable compression of said air in a moisture rich environment to enable such liquid to absorb heat generated by the compression of said air; discharge means in communication with said compressor means for discharging excess moisture from said compressor means following the compression of air; separator means; means independent of said discharge means in communication with said compressor means for delivering compressed air from said compressor means to said separator means, said separating means being operable to separate an additional quantity of moisture from said compressed air; means for discharging moisture from said separator means; refrigerator means in communication with said separator means for receiving compressed air therefrom and cooling said compressed air; and means connecting said refrigerator means to said inlet upstream from said valve means.

* * * * *